US005107788A

United States Patent [19]

Boldrini et al.

[11] Patent Number: 5,107,788

[45] Date of Patent: Apr. 28, 1992

[54] DEVICE FOR APPLYING ADHESIVE MATERIAL TO SHEETS OF PACKING MATERIAL

[75] Inventors: Fulvio Boldrini, Ferrara; Antonio Gamberini, Bologna, both of Italy

[73] Assignee: G.D Societa' Per Azioni, Bologna, Italy

[21] Appl. No.: 481,440

[22] Filed: Feb. 16, 1990

[30] Foreign Application Priority Data

Feb. 21, 1989 [IT] Italy ..... 3347 A/89

[51] Int. Cl.[5] ..... B05C 1/08

[52] U.S. Cl. ..... 118/212; 118/249; 118/258

[58] Field of Search ..... 118/212, 244, 249, 258

[56] References Cited

U.S. PATENT DOCUMENTS

| | | | |
|---|---|---|---|
| 951,425 | 3/1910 | Minahan | 118/249 X |
| 2,276,997 | 3/1942 | Richardson | 118/212 |
| 4,249,547 | 2/1981 | Hinzmann | 131/94 |
| 4,292,919 | 10/1981 | Taylor | 118/212 |
| 4,497,274 | 2/1985 | Focke | 118/212 X |
| 4,503,802 | 3/1985 | Keller et al. | 118/249 |

FOREIGN PATENT DOCUMENTS

| | | |
|---|---|---|
| 1200397 | 7/1970 | United Kingdom . |
| 1312531 | 4/1973 | United Kingdom . |

*Primary Examiner*—Michael G. Wityshyn

*Attorney, Agent, or Firm*—Marshall, O'Toole, Gerstein, Murray & Bicknell

[57] ABSTRACT

A device for applying adhesive material to sheets of packing material, wherein the locally-grooved cylindrical outer surface of a gumming roller is coated with adhesive material by a transfer roller partially immersed in a mass of adhesive material in the form of liquid or paste housed inside a tank.

The transfer roller is smaller in diameter than the gumming roller, and presents a cyclindrical outer surface which is maintained contacting, along its generating line, the partially grooved outer surface of the gumming roller by means of a radial thrust device designed to ensure substantially evenly distributed contact pressure along the aforementioned generating line.

10 Claims, 2 Drawing Sheets

DEVICE FOR APPLYING ADHESIVE MATERIAL TO SHEETS OF PACKING MATERIAL

BACKGROUND OF THE INVENTION

The present invention relates to a device for applying adhesive material to sheets of packing material. In particular, the present invention relates to a device, hereinafter referred to as a "gumming device", designed for fitment on a packing machine, for applying adhesive material to predetermined portions of product packing material, e.g. blanks.

Known gumming devices, such as the one referred to in U.S. Pat. No. 2,276,997, feature a gumming roller having grooves for receiving adhesive material on predetermined portions of its periphery, and partially immersed in a vessel containing adhesive material in the form of liquid or paste. The gumming roller is usually provided with fixed scrapers for removing excess adhesive off the roller, the remainder of which, in the form of strips inside the grooves, is applied by the gumming roller on to predetermined surface portions of blanks of packing material.

Known devices of the aforementioned type present numerous drawbacks, mainly due to the presence of said fixed scrapers which, being subject to fairly rapid wear, soon result in the formation of a film of adhesive material on the surface of the gumming roller, and frequent machine stoppages for cleaning and maintenance. As described in the introduction to U.S. Pat. No. 4,249,547, one attempt to overcome the above drawback consists in replacing the fixed scrapers with a second scraper-transfer roller arranged tangent to and pressed firmly against the peripheral surface of the grooved roller, for at least partially removing the strips of adhesive material inside the grooves and at the same time prevent further adhesive from adhering to the peripheral surface portion of the second roller unaffected by the grooves on the grooved roller. The second roller then provides for transferring the adhesive glinging to it on to predetermined portions of blanks of packing material supplied successively by a third roller substantially tangent to the second.

Perfected gumming devices of the aforementioned type, however, have been found to present additional drawbacks, due, on the one hand, to the length and diameter of the two rollers involved, and on the other, to the relatively high contact pressure required between the two rollers for ensuring only the surface portion of the second roller operating in conjunction with the grooves on the gumming roller is coated with adhesive material.

As regards the length and diameter of the two rollers, it should be pointed out that the length must be at least equal to the length of the blanks measured along the axis of the feed roller, whereas the circumference of each roller must usually be at least equal to the width of the blanks. The width and length of the blanks, and consequently the diameter and length of the two rollers, may at times be relatively large. What is more, for a given contact pressure, the contact area between the two rollers increases alongside an increase in the diameter of the rollers. Consequently, for ensuring sufficient pressure is applied between the two rollers to prevent fouling the surface portion of the second roller unaffected by the grooves on the gumming roller, relatively high contact pressure must be applied, which, in most cases, results in distortion of the roller axes and, consequently, uneven distribution of the specific contact pressures applied.

In addition to requiring an extremely strong structure and fine surface finish, the two rollers on known gumming devices of the aforementioned type are therefore also subject to local wear, which drastically reduces the working life of the rollers, thus requiring frequent maintenance and replacement.

SUMMARY OF THE INVENTION

The aim of the present invention is to provide a device for applying adhesive material to sheets of packing material, and involving none of the drawbacks typically associated with known devices of the aforementioned type.

With this aim in view, according to the present invention, there is provided a device for applying adhesive material to sheets of packing material, comprising a tank containing adhesive material in the form of liquid or paste; and a gumming roller having a locally-grooved cylindrical outer surface, and arranged with its generating line tangent to the travelling direction of said sheets; characterised by the fact that it also comprises a transfer roller located partially inside said tank and partially immersed inside said adhesive material; said gumming roller being located substantially outside said tank; said transfer roller being smaller in diameter than said gumming roller and having a cylindrical outer surface; and thrust means being provided for maintaining the outer surface of said transfer roller contacting, along its generating line, the outer surface of said gumming roller, with substantially evenly distributed contact pressure.

On the above device, the only roller whose size is related to that of the blanks is the gumming roller, whereas the transfer roller may be of any, even extremely small, diameter. A reduction in the diameter of the transfer roller results in an equal reduction in the contact area between the two rollers and, consequently, in the force required for obtaining specific predetermined contact pressures. Moreover, the outer surface portion of the transfer roller permanently located diametrically opposite its generating line contacting the gumming roller is left free, and may be engaged by push members arranged along the axis of the transfer roller in such a manner as to substantially evenly distribute the contact pressure between the two rollers along said generating line. In particular, using a relatively slim and therefore flexible transfer roller, the axis of the same may be deformed locally by means of said push members, so as to compensate for any surface flaws and/or wear and so permanently ensure perfect contact between the two rollers along the entire genearating line.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 2:
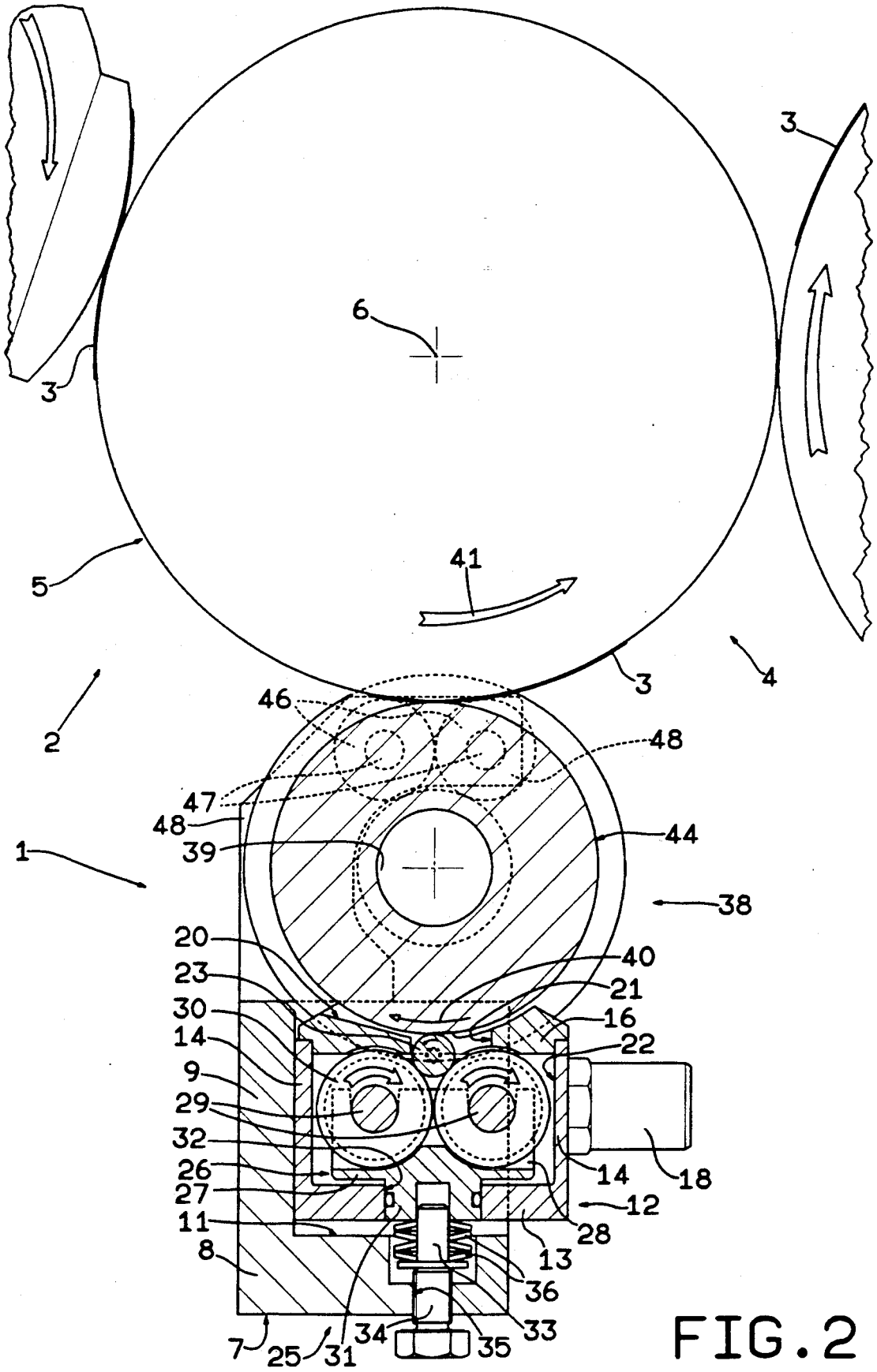
FIG. 2 shows a section along line II—II in FIG. 1.

Number 1 in FIG. 2 indicates a gumming device mounted on a packing machine 2, for applying a film of adhesive material to predetermined portions of blanks 3 supplied successively by a conveyor unit 4 having a roller 5 turning about an axis 6 and connected to device 1.

Figure 1:
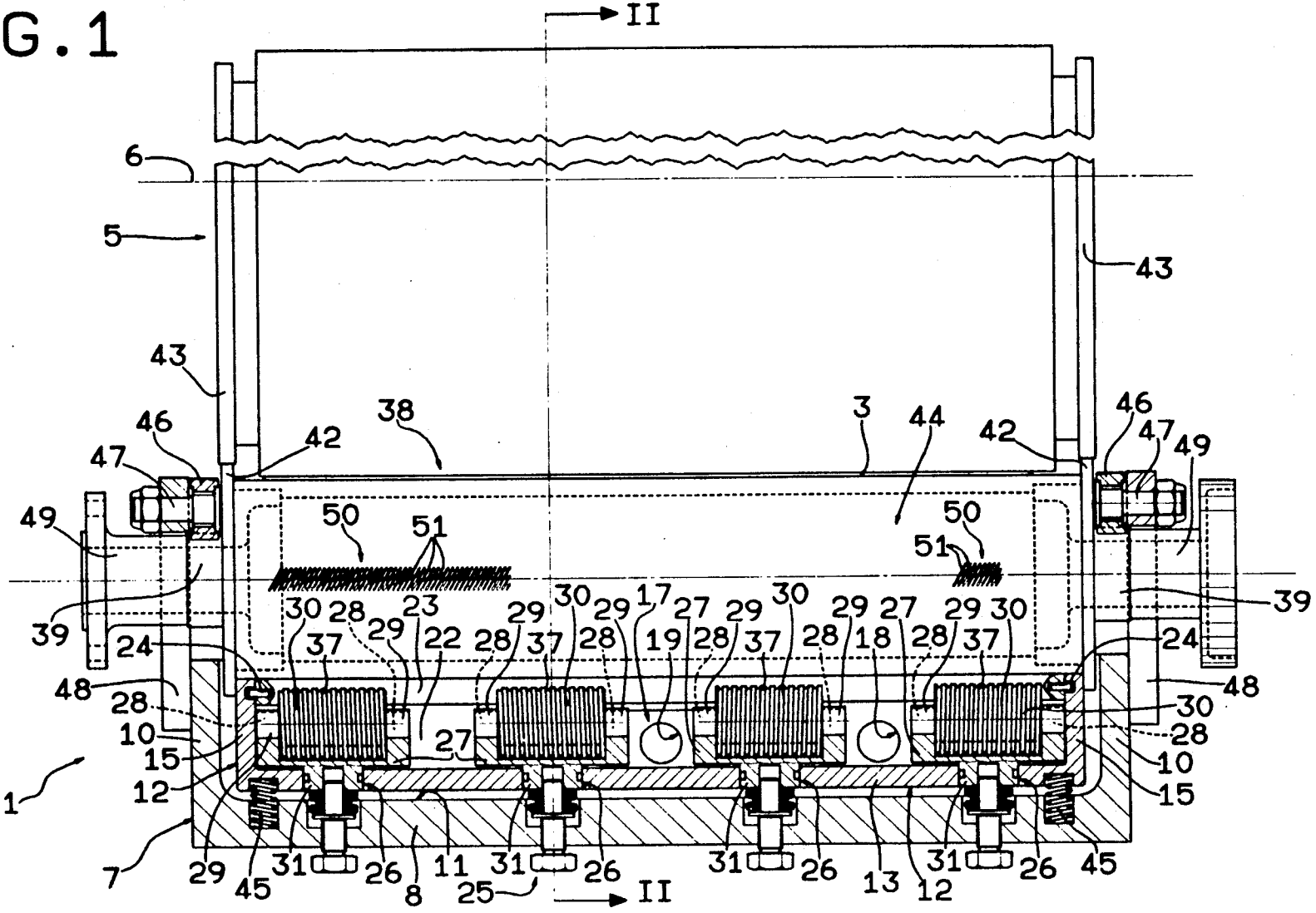
FIG. 1 shows a partially-sectioned view of a device in accordance with the teachings of the present invention.

As shown in FIGS. 1 and 2, device 1 comprises an outer frame 7 supported on machine 2 in a manner not shown and consisting of a substantially rectangular end plate 8 having its longer axis parallel to axis 6. From the lateral edges of plate 8, there extend, towards roller 5, a lateral shoulder 9 and two end shoulders 10, all perpendicular to and integral with plate 8, so as to form a container 11 open towards roller 5 as well as laterally on the opposite side of shoulder 9.

Container 11 substantially houses a tank 12 substantially in the form of a rectangular parallelepipedon with its major axis parallel to axis 6. Tank 12 is designed to contain adhesive material in the form of liquid or paste, and comprises a bottom wall 13 facing and parallel to plate 8, two longitudinal lateral walls 14 parallel to shoulder 9, two transverse lateral walls 15 parallel to and respectively facing shoulders 10, and a lid 16 substantially parallel to wall 13 and facing roller 5.

Tank 12 forms part of a circuit 17 for circulating said adhesive material, for which purpose it presents one or more inlet pipes 18 and one or more outlet pipes 19 connected through wall 14 opposite wall 14 facing shoulder 9.

As shown in FIG. 2, the outer surface of lid 16 presents a groove 20 having a section substantially in the form of an arc of a circle, and running parallel to axis 6. Said groove 20 presents a slot 21 enabling external communication of the inner chamber 22 of tank 12, and partially closed by a roller 23 hereinafter referred to as the "transfer roller." Said transfer roller is a preferably smooth cylindrical roller of relatively small section and such as to render it substantially flexible.

As shown in FIG. 1, transfer roller 23 is located between walls 15 with its axis parallel to axis 6, and presents two axial end pins 24 designed to engage, in rotary and radially slack manner, respective holes formed in respective walls 15 of tank 12.

Transfer roller 23 is supported in idle manner inside slot 21 in such a position as to be partially immersed inside said adhesive material, and to project slightly outwards of slot 21 and inside groove 20.

Transfer roller 23 is supported in adjustable manner inside tank 12 by a thrust roller device 25 comprising a number of independent mobile frames 26 housed inside tank 12. Each frame 26 is substantially U-shaped, and comprises a bottom wall 27 facing wall 13 and fitted on its opposite ends with two walls 28 substantially perpendicular to axis 6 and parallel to walls 15. Two shafts 29, parallel to each other and to axis 6, are mounted for rotation through walls 28, and are fitted with two side by side, substantially tangent rollers 30 defining a V-shaped saddle supporting a respective portion of transfer roller 23.

On thrust device 25, said pairs of rollers 30 are aligned so as to form two rows of rollers substantially equally spaced along the axis of transfer roller 23. From each wall 27, a pin 31 projects towards wall 13, which pin 31 engages in fluidtight manner a respective hole 32 formed through wall 13, and presents, on its free end, an axial dead hole engaged in sliding manner by the end of a small-diameter cylindrical pin 33 integral with the end of a screw or adjusting means 34 engaged in adjustable manner inside a threaded hole 35 formed through plate 8 coaxial with respective hole 32. Compressed Belleville washers 36, fitted through with pin 33, are provided between the end surface of each pin 31 and an annular shoulder formed on the end of screw 34.

As shown in FIG. 1, each roller 30 presents a peripheral thread 37, hereinafter referred to as pump means, arranged in such a manner as to "pump" the adhesive material inside tank 12 and so ensure relatively fast circulation of the same through tank 12 and along hydraulic circuit 17.

Between transfer roller 23 and roller 5 of conveyor unit 4, provision is made for a further roller 38, hereinafter referred to as the "gummimg roller", having a central supporting shaft 39 parallel to axis 6 and normally powered by drive means (not shown) so as to turn about its axis in the direction of arrow 40 and in the opposite direction to arrow 41 indicating the rotation direction of roller 5.

As shown in FIG. 1, each end of roller 38 presents a flange 42 having an outer cylindrical surface tangent to the outer cylindrical surface of a corresponding flange 43 on roller 5. When said two pairs of flanges 42 and 43 are arranged tangent, the outer cylindrical surface 44 of roller 38 is "substantially" tangent to the outer surface of roller 5, so as to define a narrow passage for blanks 3.

As shown in FIG. 2, surface 44 of gumming roller 38 is arranged tangent, along its generating line parallel to axis 6, to the outer cylindrical surface of transfer roller 23, and engages, in substantially fluidtight manner, groove 20 on lid 16 of tank 12, which is thrust towards the periphery of gumming roller 38 by a number of helical springs 45 between plate 8 and wall 13 of tank 12.

Gumming roller 38 is maintained in said position by two pairs of reaction rollers 46, each supported, via the interposition of pins 47 parallel to axis 6, by a respective bracket 48 surrounding a respective end portion 49 of shaft 39 projecting from gumming roller 38 and connected integral with a respective shoulder 10 of frame 7. Each pair of rollers 46 defines a V-shaped saddle for supporting said respective portion 49 of shaft 39 against the thrust exerted on gumming roller 38 by thrust device 25 via transfer roller 23.

As shown in FIG. 1, surface 44 of gummimg roller 38 presents a number of grooved portions 50, each corresponding to a gumming surface portion of blanks 3. To ensure optimum support of said portions 50 on transfer roller 23 while at the same time minimising adhesive splash during transfer of the same from transfer roller 23 to portions 50 on gumming roller 38, said portions 50 present a number of grooves 51 inclined at a given angle in relation to the axis of shaft 39. In actual use, by adjusting the setting of screws 34, rollers 23 and 38 are compressed against each other between the two rows of thrust rollers 30 and the two pairs of reaction rollers 46. In particular, by virtue of the relatively thin, flexible nature of roller 23, adjustment of screws 34 provides for regulating the contact pressure between rollers 23 and 38 as required, and in such a manner that it is substantially evenly distributed over the contact generating line between rollers 23 and 38.

In connection with the above, it should be pointed out that the thrust required, via device 25, for enabling roller 23 to transfer the adhesive from tank 12 to portions 50 of gumming roller 38, without fouling the rest of surface 44 on roller 38, is relatively small on account of the small diameter and flexibility of transfer roller 23.

We claim:

1. A device, for applying adhesive material to sheets (3) of packing material, comprising:

a tank (12) containing adhesive material in the form of liquid or paste;

a gumming roller (38) having a locally-grooved cylindrical outer surface and arranged with its generating line tangent to the travelling direction of the sheets (3);

the gumming roller (38) being located substantially outside the tank (12);

a transfer roller (23) located partially inside the tank (12) and partially immersed in the adhesive material, the transfer roller (23) being smaller in diameter than the gumming roller (38) and having a cylindrical outer surface; and thrust means (25) comprising a roller support (26-30) for the transfer roller (23) for maintaining contact of the outer surface of the transfer roller (23), along its generating line, with the outer surface of the gumming roller (38) with substantially evenly distributed contact pressure.

2. A device as claimed in claim 1, characterised by the fact that said gumming roller (38) presents a smooth cylindrical outer surface (44) having a number of grooved portions (50) with grooves (51) inclined at a given angle in relation to the axis of said gumming roller (38).

3. A device as claimed in claim 1, characterised by the fact that said roller support (26-30) comprises a mobile frame (26) housed inside said tank (12) and designed to move, in adjustable manner and in relation to said tank (12), to and from said gumming roller (38); and a number of thrust rollers (30) mounted for rotation on said frame (26) and aligned along two axes parallel to said transfer roller (23) so as to form two rows of rollers tangent to and substantially equally spaced along said transfer roller (23).

4. A device as claimed in claim 3, characterised by the fact that said mobile frame (26) comprises a number of independent portions, each supporting a pair of said thrust rollers (30) arranged side by side and defining a V-shaped saddle supporting a respective portion of said transfer roller (23).

5. A device as claimed in claim 4, characterised by the fact that said device comprises a fixed outer frame (7) supporting said tank (12); said thrust means (25) comprising first elastic means (36) located between said fixed outer frame (7) and each said portion of said mobile frame (26) for achieving contact and a given contact pressure between said transfer roller (23) and said gumming roller (38), and means (33, 34) for regulating the thrust of each said first elastic means (36); and reaction means (46) being provided on said fixed outer frame (7) and assigned to said gumming roller (38) in opposition to said thrust means (25).

6. A device as claimed in claim 5, characterised by the fact that said fixed outer frame (7) comprises a plate (8) facing the bottom wall (13) of said tank (12); and two brackets (48) extending from said plate (8) towards said gumming roller (38) at opposite ends of the same, and each supporting a respective said reaction means (46).

7. A device as claimed in claim 6, characterised by the fact that each said reaction means comprises two side by side reaction rollers (46) tangent to a respective end portion (49) of said gumming roller (38).

8. A device as claimed in claim 7, characterised by the fact that second elastic means (45) are provided between said tank (12) and said fixed outer frame (7) for pushing said tank (12) towards said gumming roller (38).

9. A device as claimed in claim 3, characterised by the fact that said tank (12) comprises at least an inlet (18) and outlet (19) for said adhesive material; said tank (12) forming part of a hydraulic circuit (17) for circulating said adhesive material; and pump means (37) being provided inside said tank (12) for ensuring forced circulation of said adhesive material along said circuit (17).

10. A device as claimed in claim 9, characterised by the fact that each said roller (30) on said roller support (26-30) presents an external thread (37); said threaded rollers (30) combining to form said pump means.

* * * * *